US005582465A

United States Patent [19]

Mraz

[11] Patent Number: 5,582,465

[45] Date of Patent: Dec. 10, 1996

[54] METHOD AND APPARATUS FOR MINING INCLINED MINERAL DEPOSITS

[75] Inventor: Dennis Mraz, Saskatoon, Canada

[73] Assignee: DM Technologies Ltd., Saskatoon, Canada

[21] Appl. No.: 367,858

[22] Filed: Jan. 3, 1995

[51] Int. Cl.[6] ..... E21C 29/10; E21C 35/20

[52] U.S. Cl. ..... 299/18; 299/64

[58] Field of Search ..... 299/18, 30, 64

[56] References Cited

U.S. PATENT DOCUMENTS

| | | | |
|---|---|---|---|
| 1,723,383 | 8/1929 | Smith | 299/18 X |
| 2,143,522 | 1/1939 | McCarthy | 299/18 |
| 5,246,274 | 9/1993 | Smith et al. | 299/64 X |

FOREIGN PATENT DOCUMENTS

| | | | |
|---|---|---|---|
| 920206 | 4/1982 | U.S.S.R. | 299/64 |
| 968400 | 10/1982 | U.S.S.R. | 299/64 |
| 1314061 | 5/1987 | U.S.S.R. | 299/18 |

*Primary Examiner*—David J. Bagnell
*Attorney, Agent, or Firm*—Morgan & Finnegan

[57] ABSTRACT

A method and apparatus for haulage of material in a self-propelled vehicle on a sloped surface by supplementing traction force of the self-propelled vehicle by rope under variable tension in order to achieve the desired velocity of haulage.

6 Claims, 2 Drawing Sheets

METHOD AND APPARATUS FOR MINING INCLINED MINERAL DEPOSITS

FIELD OF THE INVENTION

The present invention relates generally to mining and specifically to mining bedded mineral deposits inclined from horizontal plane.

DESCRIPTION OF THE RELATED ART

One of the most common methods of underground mining in bedded deposits of minerals such as coal is a room and pillar method. In this method the mine openings excavated within the seam of mineral are usually laid out according a predetermined pattern. The parts of the seam left between the openings form pillars, which are designed to hold the weight of overlying rocks while the mining is conducted. Typically, pillars are square or rectangular. Sometimes, pillars are formed between long parallel openings and such mining method is identified as long rooms and pillars.

The excavated mineral must be hauled out of the mining faces to the surface by a haulage equipment. The most common method of haulage at underground mining faces is haulage with Load-Haul-Dump vehicles or LHD's, which utilize wheels with rubber tires. Typically two or more LHD's alternate at being loaded at the mining face and carrying the excavated mineral to another means of haulage such as belt conveyor.

The haulage with LHD's is limited to horizontal or near horizontal mine openings, as LHD's cannot operate efficiently on slopes exceeding 15%, because of the limitations of traction. Therefore, it would be desirable to obtain a method of LHD haulage capable of operating on slopes substantially exceeding 15%.

SUMMARY OF THE INVENTION

Figure 1:
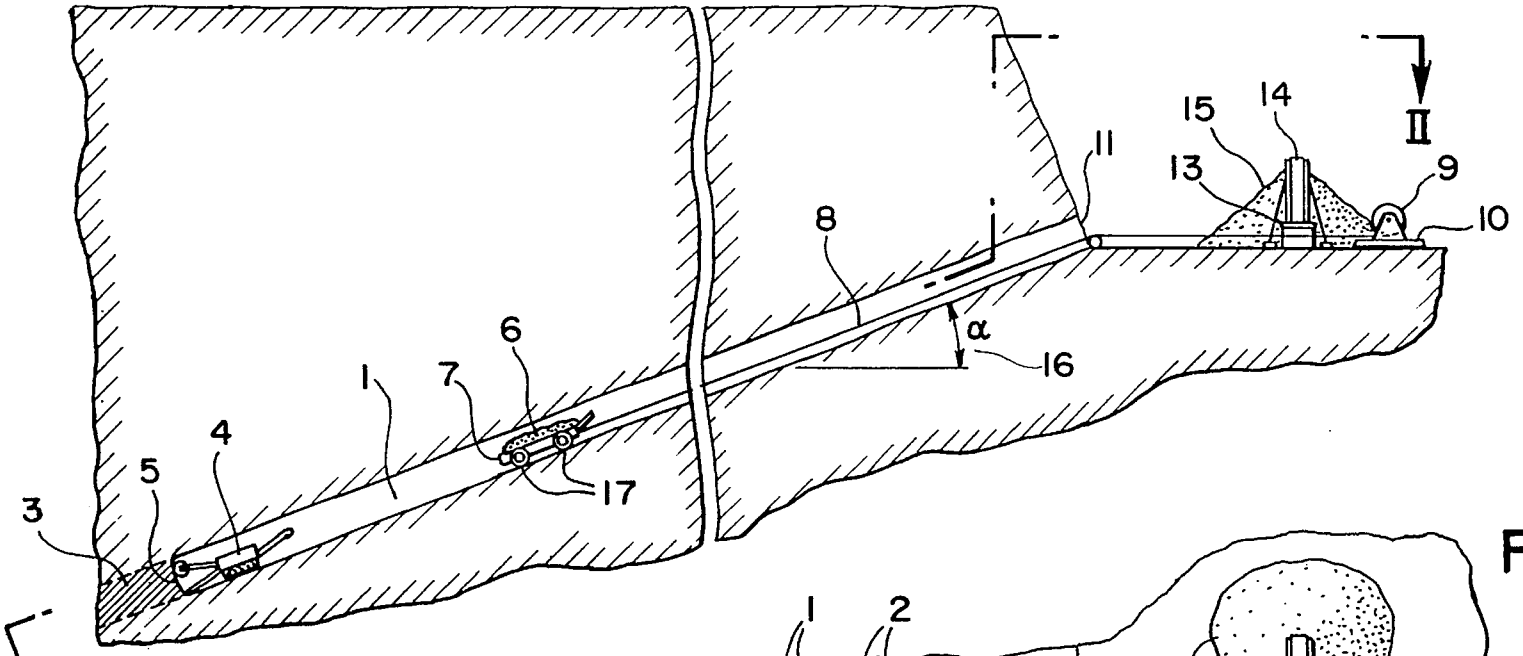
FIG. 1 is a schematic, vertical sectional view showing a preferred embodiment of the present invention.
Figure 2:
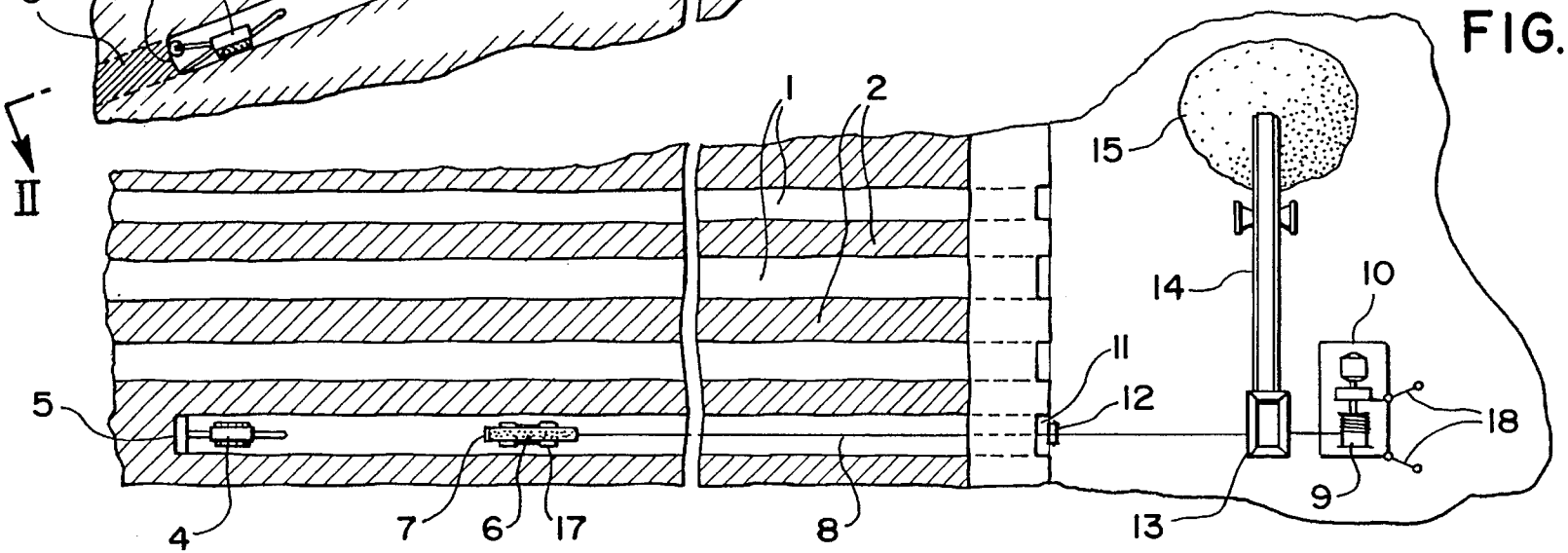
FIG. 2 is a sectional view taken along line II—II of FIG. 1.

An object of the present invention is therefore to obtain an LHD haulage that can operate on slopes substantially inclined from horizontal. Such LHD haulage is obtained by suspending any commonly available LHD on a rope connected to the winch, which maintains a predetermined speed or tension, or both, within the rope and thus assists the LHD in propelling itself on a sloped surface.

DETAILED DESCRIPTION OF THE PREFERRED EMBODIMENTS

Referring to FIGS. 1 through 4, long room and pillar mining consists of rooms 1 and pillars 2 within the inclined ore body 3. Mining machine 4 excavates in the mining face 5. Excavated rock 6 is hauled from the face 5 by the self-propelled LHD 7. The LHD 7 is suspended on rope 8 wound over the drum 9 of the winch 10 anchored by tie-downs 18. At the entrances 11 of rooms 1 the rope 8 is supported by roller 12. Rope 8 is located under the hopper 13 of the conveyor 14 which discharges onto an ore stockpile 15 or onto other means of haulage.

Because of the steep angle of inclination 16 of the rooms 1, the LHD 7 is incapable of hauling excavated rock 6 on its own power up and down the room 1. To facilitate such haulage, winch 9 maintains a predetermined or preprogrammed speed of winding rope 8, varying torque on the drum 9 as required, thus supplementing traction force developed by the LHD 7 through its tires 17. Stops and starts of the LHD 7 will also activate stops and starts of the drum 9.

Figure 3:
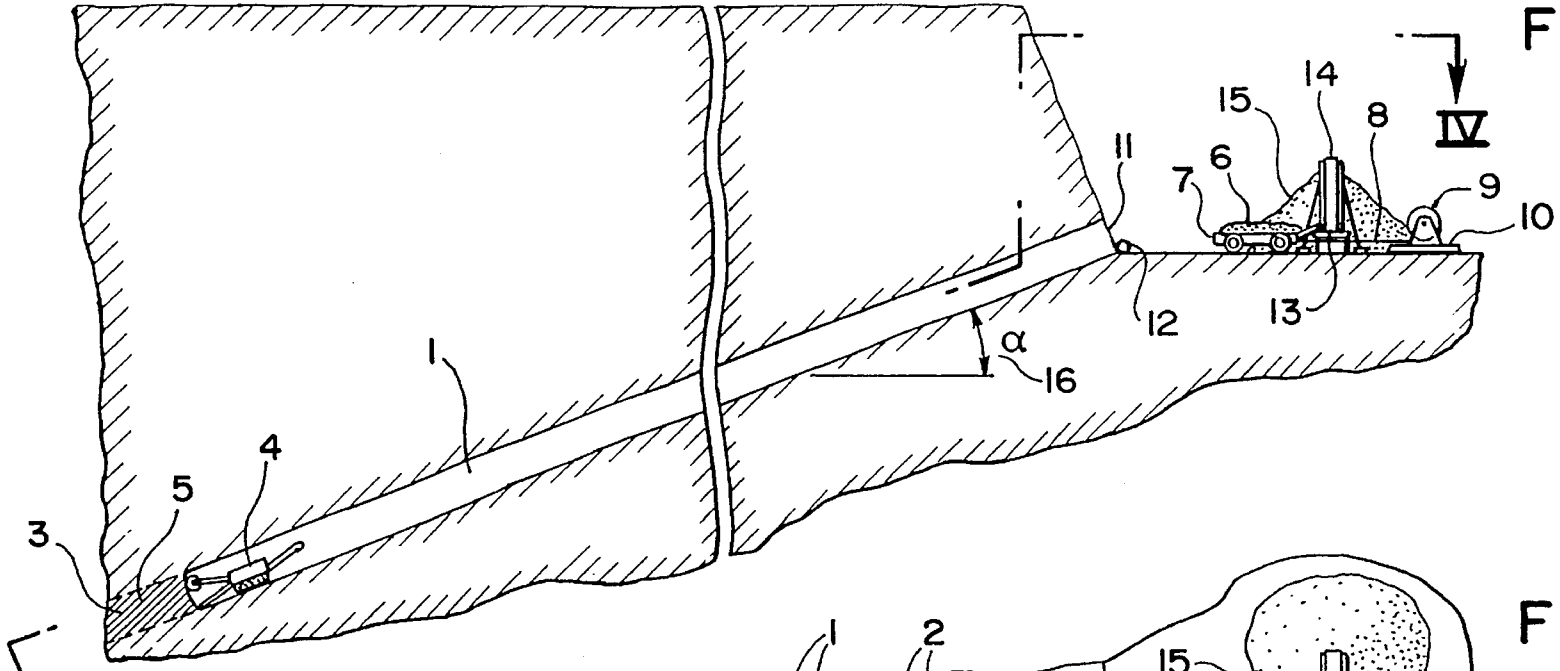
FIG. 3 is a schematic, vertical sectional view similar to FIG. 1, but showing the LHD vehicle in a withdrawn position.
Figure 4:
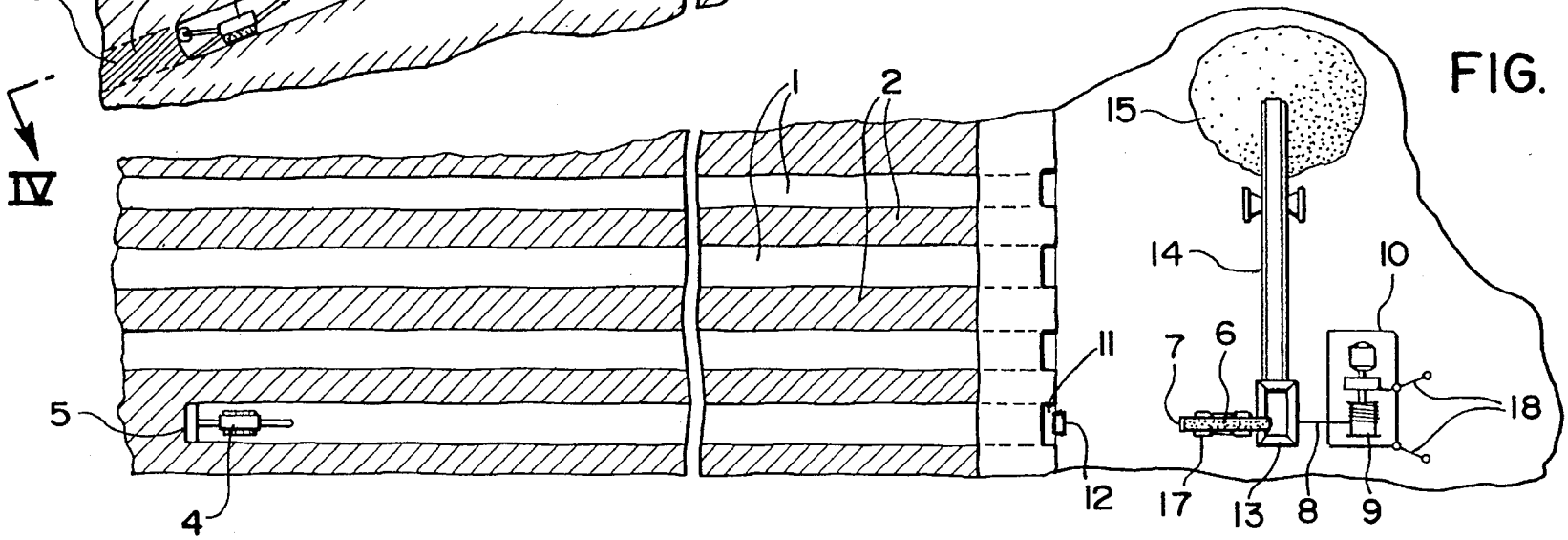
FIG. 4 is a sectional view taken along line III—III of FIG. 3.

Referring to FIGS. 3 and 4, both LHD 7 and the drum 9 of the winch 10 stop when the LHD is positioned at the hopper 13 where the LHD 7 discharges the excavated rock 6 prior to returning to the mining machine 4.

Numerous modifications and adaptations of the present invention will be apparent to those skilled in the art and it is intended by the following claims to cover all such modifications which fall within the true spirit of this invention.

What is claimed is:

1. A method for hauling material from a mine having sloped openings comprising the steps of:

connecting a vehicle having driven wheels for propulsion to a winch located outside the sloped openings;

paying out cable from the winch while the vehicle descends into the sloped opening to be loaded by a mining machine; and taking up cable with the winch as the vehicle ascends from the sloped opening, thereby pulling the vehicle while it propels itself up the sloped opening.

2. A method according to claim 1, further comprising maintaining a predetermined tension in the winch cable by varying the torque on a drum of the winch.

3. A method according to claim 1, further comprising maintaining a predetermined speed at which the cable is taken up while varying the tension in the cable.

4. An apparatus for hauling material from a mine having sloped openings comprising:

a vehicle having driven wheels for propulsion; and a winch having a cable connected to the vehicle and being located outside the sloped openings;

the winch being capable of paying out cable while the vehicle descends into the sloped opening to be loaded by a mining machine and being capable of taking up cable with the winch as the vehicle ascends from the sloped opening, thereby pulling the vehicle while it propels itself up the sloped opening.

5. An apparatus according to claim 4, further comprising a support roller disposed at an entrance to the sloped opening to support the cable of the winch as it exits the sloped opening.

6. An apparatus according to claim 4, further comprising means for maintaining constant tension on the cable of the winch during extraction of the vehicle from the sloped opening.

* * * * *